US008038323B2

(12) United States Patent
Ratmansky et al.

(10) Patent No.: US 8,038,323 B2
(45) Date of Patent: Oct. 18, 2011

(54) APPARATUS FOR DISPLAYING AN OBJECT HAVING RELIEF

(76) Inventors: Paul Phillip Ratmansky, Philadelphia, PA (US); Joel David Ratmansky, Philadelphia, PA (US)

( * ) Notice: Subject to any disclaimer, the term of this patent is extended or adjusted under 35 U.S.C. 154(b) by 262 days.

(21) Appl. No.: 12/201,770

(22) Filed: Aug. 29, 2008

(65) Prior Publication Data

US 2009/0056176 A1 Mar. 5, 2009

Related U.S. Application Data

(60) Provisional application No. 60/969,074, filed on Aug. 30, 2007.

(51) Int. Cl.
*F21V 4/00* (2006.01)

(52) U.S. Cl. ..... 362/249.16; 362/104; 362/249.01; 40/323

(58) Field of Classification Search ..... 362/26, 362/29, 30, 103, 104, 200, 249.01, 249.02, 362/249.06, 249.16, 253, 619, 625, 800, 362/806; 40/27.5, 323, 364, 541–544, 587, 40/588

See application file for complete search history.

(56) References Cited

U.S. PATENT DOCUMENTS

| | | | | |
|---|---|---|---|---|
| 2,467,043 | A | 4/1949 | Kotler | |
| 2,569,212 | A | 9/1951 | Zagotti | |
| 2,704,211 | A | 3/1955 | Decipoli | |
| 3,481,652 | A | 12/1969 | Mazerolle | |
| 3,953,932 | A | 5/1976 | Graves | |
| 4,441,762 | A | 4/1984 | Segal | |
| 4,534,185 | A | 8/1985 | Berry | |
| 4,940,441 | A | 7/1990 | Novinsky | |
| 4,977,695 | A * | 12/1990 | Armbruster | 40/541 |
| 5,058,959 | A | 10/1991 | Miles | |
| 5,092,806 | A | 3/1992 | Brown | |
| 5,316,376 | A | 5/1994 | Defreitas | |
| 5,697,858 | A | 12/1997 | Lekavich | |
| 5,934,784 | A * | 8/1999 | Dion | 362/103 |
| 5,984,485 | A * | 11/1999 | Poli et al. | 362/26 |
| 6,190,026 | B1 * | 2/2001 | Moore | 362/487 |
| 6,217,468 | B1 | 4/2001 | Goodwin | |
| 6,248,034 | B1 | 6/2001 | Voloshen | |
| 6,309,027 | B1 | 10/2001 | Smith | |
| 6,685,338 | B1 * | 2/2004 | Lewis et al. | 362/234 |
| 6,973,747 | B2 * | 12/2005 | Ratmansky et al. | 40/327 |
| 7,175,324 | B2 * | 2/2007 | Kwon | 362/545 |
| 7,437,840 | B2 * | 10/2008 | Ratmansky et al. | 40/27.5 |
| 2001/0036877 | A1 | 11/2001 | Hartman | |
| 2002/0108280 | A1 * | 8/2002 | Fernandez | 40/323 |
| 2003/0033738 | A1 * | 2/2003 | Lii | 40/364 |
| 2003/0112619 | A1 * | 6/2003 | Ewers et al. | 362/27 |

FOREIGN PATENT DOCUMENTS

| | | | |
|---|---|---|---|
| EP | 458203 | A2 | 11/1991 |
| FR | 2627972 | A1 * | 9/1989 |
| JP | 59120983 | A * | 7/1984 |

* cited by examiner

*Primary Examiner* — Hargobind Sawhney
(74) *Attorney, Agent, or Firm* — Robert J. Yarbrough

(57) ABSTRACT

The present Invention is an apparatus for displaying a medallion in an item of memorabilia, such as a hockey puck or a model of a tire. A medallion is selectably retained by a cavity defined by the item of memorabilia. A light-emitting capacitor is disposed either in front of or behind the medallion, illuminating the surface of the medallion.

14 Claims, 8 Drawing Sheets

APPARATUS FOR DISPLAYING AN OBJECT HAVING RELIEF

I. RELATED APPLICATIONS

This application claims priority from provisional patent application No. 60/969,074 filed Aug. 30, 2007 by the inventors named herein. Provisional application 60/969,074 is hereby incorporated by reference.

II. BACKGROUND OF THE INVENTION

A. Field of the Invention

The invention is related to the display of objects having relief, such as minted coins or medallions. The object having relief may be inset for display into an item of memorabilia such as an ice hockey puck or a model of a tire. The inset object having relief may be illuminated to highlight the relief. Illumination may be provided by one or more light-emitting capacitor lamps.

B. Description of the Related Art

An object having relief, such as a minted medallion, may be incorporated into a sports memorabilia apparatus, as is taught by U.S. Pat. No. 6,973,747 issued Dec. 13, 2005 to the inventors named herein and as taught in pending application Ser. No. 11/284,073 filed Nov. 18, 2005 by the inventors named herein. The patent and pending application are hereby incorporated by reference into this application.

III. BRIEF DESCRIPTION OF THE INVENTION

A minted coin or medallion having relief is inset into a display surface of a item of memorabilia, such as a hockey puck or a model of a tire, as taught by issued U.S. Pat. No. 6,973,747 and pending application Ser. No. 11/284,073. The present invention improves upon the invention taught by that patent and that application by providing light-emitting capacitor lamps configured to illuminate the coin or medallion from a shallow angle, highlighting the relief of the coin or medallion and enhancing the value of the combination of the object and the medallion to a collector of memorabilia.

The present Invention is particularly applicable to the display of a coin, medallion or other object having a highly reflective surface and having relief formed by minting technology. As used in this application, a "medallion" is any such object. The inventors have discovered that minted medallions having highly reflective surfaces are most effectively displayed when light is directed across the surface of the medallion at a shallow angle. The inventors also have discovered that substantially uniform, even illumination of a highly reflective, minted medallion from all directions by a light source located around the circumference of the medallion provides a striking visual effect.

Since the amount of relief minted into coins and medallions is small, conventional incandescent or fluorescent lights are too large to achieve the shallow angles that are most effective for displaying the small amount of relief present. Light-emitting capacitor lamps can provide substantially uniform, even illumination and have proven suitable in practice.

One or more light-emitting capacitor lamps may be used as a light source. Light emitting capacitor lamps offer the advantage of being readily formed into thin sheets of any desired shape. The light emitting capacitor lamp may be formed into a narrow strip and the strip bent into a circular shape with a diameter slightly larger than that of the medallion. The light-emitting capacitor lamp is configured so that the illuminated surface of the lamp is directed toward the inside of the circle.

The circular medallion is inset into a circular cavity in a hockey puck or other item of memorabilia so that a display side of the medallion is visible to an observer. The circular light-emitting capacitor lamp is mounted within the cavity in the item of memorabilia between the level of the medallion and the surface of the item of memorabilia, thereby allowing the light-emitting capacitor lamp to evenly illuminate the display surface of the medallion from the circumference of the medallion. The shallow angle of illumination allows the relief of the medallion to be highlighted. The substantially even illumination from all directions provides a striking visual effect. While the medallion has a display side and a hidden side when the medallion is in place in the item of memorabilia, the medallion may bear relief on both sides and the hidden and display sides may be swapped one for the other.

A power supply and switch mounted within the item of memorabilia allows the light-emitting capacitor lamp to be selectably illuminated. The power supply may be a battery. Alternatively, the power supply may be an electrical cord leading from the item of memorabilia to a wall outlet.

A separate display module may be utilized. The display module holds the medallion, the lamp and the power supply. The display module is itself inset into an opening in the item of memorabilia. The display module defines the cavity that receives the medallion. The circular light-emitting capacitor is inset into the cavity of the display module, thus illuminating the medallion from the circumference of the medallion. The separate display module houses the power supply and the electrical switch. The separate display module may be formed using any suitable technology, such as injection molding of a polymer. Use of the separate display module has the advantage of avoiding complex machining or forming of the item of memorabilia.

The light emitting capacitor lamp may be formed in the shape of a disk, or any other shape, and mounted behind a translucent or transparent case holding the medallion. Light from the light emitting capacitor then will travel through the translucent or transparent case to the front of the case and will illuminate the display side of the medallion at a shallow angle. The transparent or translucent case may be used with or without the separate display module.

When the transparent case is used without separate display module, the cavity defined by the item of memorabilia is configured so that the case containing the medallion may be inset at or below the surface of the hockey puck. The light-emitting capacitor lamp is mounted within the cavity and behind the case. Light from the lamp is directed toward the case. The light from the light-emitting capacitor lamp enters the material composing the case and is conveyed by the material composing the case around the medallion and illuminates the display surface of the medallion at a shallow angle, highlighting the relief minted into the medallion. The switch may be configured so that a press on the surface of the case activates the switch, either illuminating or extinguishing the lamp.

The translucent or transparent case may be configured to assist in the effective illumination of the medallion. The front side of the case may be provided with an annular mask or with an annular reflective surface. The annular mask or reflective surface blocks light from the light-emitting capacitor lamp from exiting the sides of the case and travelling toward a viewer, enhancing the view by the viewer of the illuminated medallion within the case. The case also may be shaped to reduce loss of light traveling from the rear of the case toward the front of the case and to direct that light toward the surface of the medallion. The shape of the case may be angled or may be rounded, or both, as determined to best transmit light from the rear of the case to the surface of the medallion.

While this application will discusses the Invention as an apparatus for illuminating a minted medallion that is inset into the surface of an item of memorabilia, the Invention applies equally to an apparatus for illuminating a medallion when the medallion is inset into any other surface. The surface into which the coin or medallion is inset may be formed of any material, such as wood, stone, concrete, metal or polymer.

IV. BRIEF DESCRIPTION OF THE DRAWINGS

V. DETAILED DESCRIPTION OF AN EMBODIMENT

U.S. Pat. No. 6,973,747 and Pending application Ser. No. 11/284,073 teach insetting of a minted medallion 2 into an item of memorabilia 4 such as a hockey puck or a model of a tire. The combination of the minted medallion 2 and the item of memorabilia 4 is desirable to a collector. The present Invention relates to the illumination of a medallion 2 when the medallion 2 is inserted into a item of memorabilia 4. The item of memorabilia 4 may be any object, but will be referred to in this application as a hockey puck.

Figure 1:
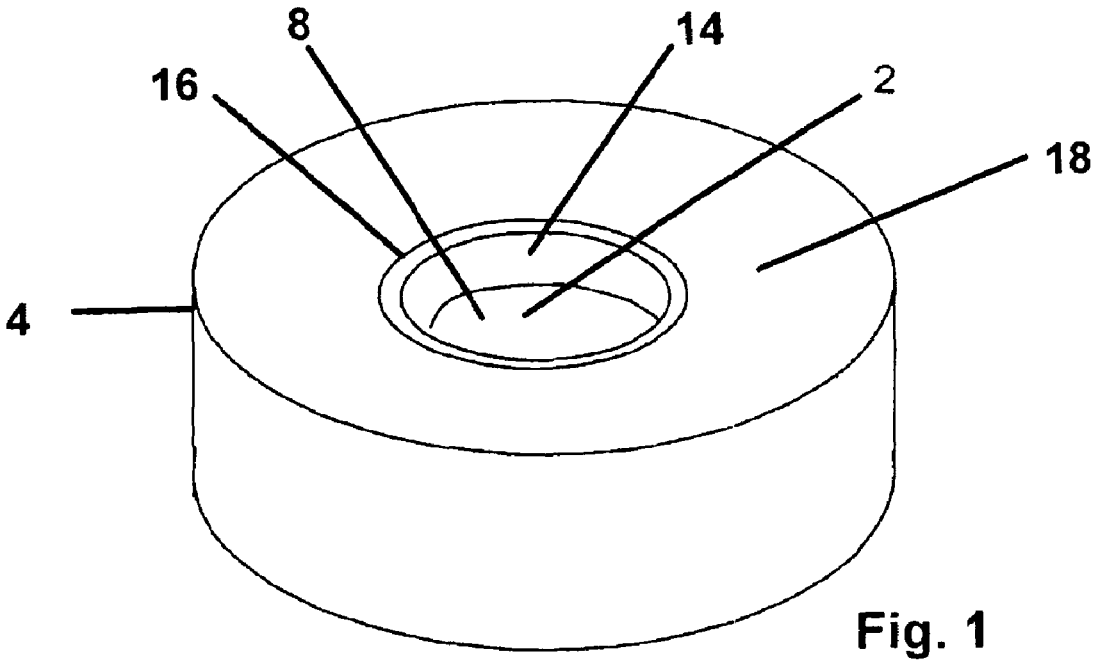
FIG. 1 is a perspective view of the Invention.
Figure 2:
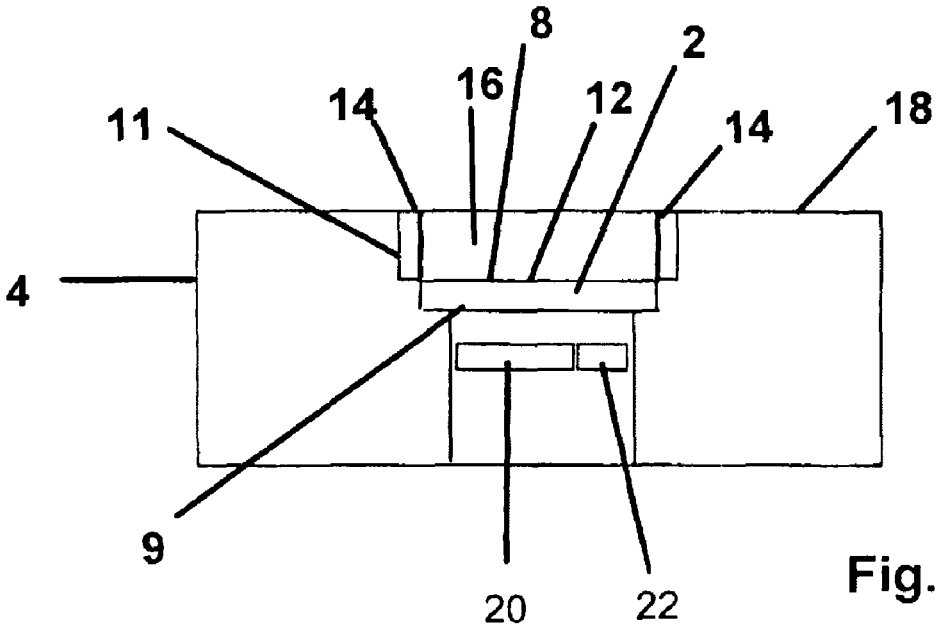
FIG. 2 is a cross section of the Invention.
Figure 3:
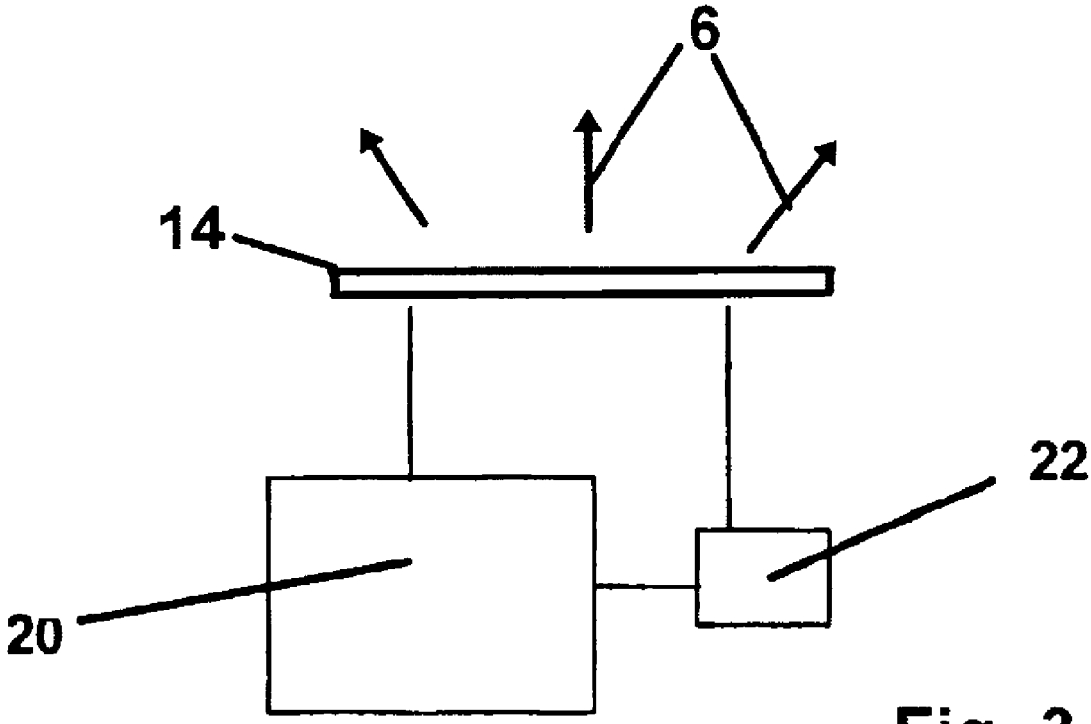
FIG. 3 is a schematic electrical diagram of the Invention.
Figure 4:
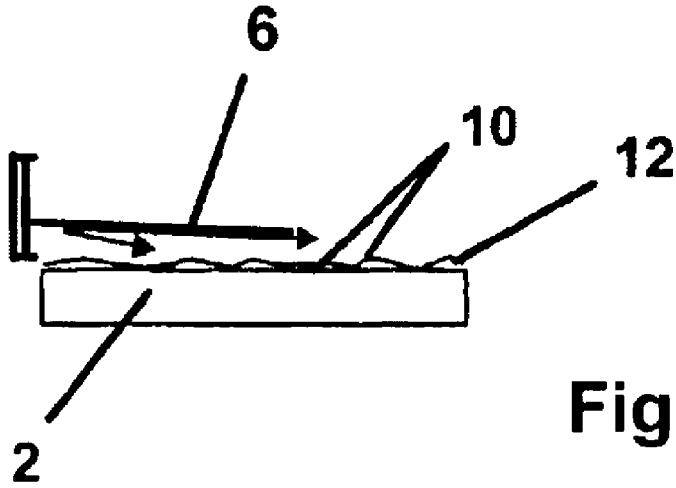
FIG. 4 is a schematic diagram of the illumination by a light-emitting capacitor lamp of the relief minted into a medallion.

A first embodiment is shown by FIGS. 1 and 2 and further illustrated by FIGS. 3 and 4. In the embodiment illustrated by FIGS. 1 and 2, a cavity 16 is formed in the item of memorabilia 4 and communicates through the item of memorabilia 4. Medallion 2 is inserted into and retained in the cavity 16. A display side 8 of medallion 2 is visible to an observer when the medallion 2 is retained by cavity 16 and a hidden side 9 is not visible to the observer. The cavity 16 defines a cavity side wall 11 that releasably engages medallion 2. The cavity 16 may be machined into the surface 18 of the item of memorabilia 4 or may be molded or otherwise formed in the surface 18. A light-emitting capacitor lamp 14 in the form of a thin strip is formed into a circle and mounted within the cavity 16 between the medallion 2 and the surface 18 of the item of memorabilia 4. Light 6 from the light-emitting capacitor lamp 14 is directed across the surface 12 of the medallion 2. A power supply 20 powers the light-emitting capacitor lamp 14. A switch 22 controls the selective illumination of the lamp 14.

FIG. 3 illustrates the electrical components of the Invention. A power supply 20 provides electrical power. The power supply 20 may be a battery or may be powered by a wall outlet. A switch allows selectable illumination of the light-emitting capacitor lamp 14. Light-emitting capacitor lamps 14 offer the advantage that the lamp 14 may be formed into thin sheets of any desired shape and will emit light 6 uniformly from its surface. Suitable light-emitting capacitor lamps 14 are available from Ceelite, 475 Sentry Parkway, Suite 3000, Blue Bell, Pa. 19422.

FIG. 4 illustrates the shallow angle of illumination of the relief 10 minted into the medallion 2. For highly reflective objects, such as a coin or medallion 2, illumination of relief 10 by a non-point, area light source, such as a light-emitting capacitor lamp 14, adequately close to the surface 12 of the medallion 2 so as to create visible highlights caused by the relief 10 substantially enhances the display of the medallion 2. Diffuse light 6 from the circumference of the medallion 2 provides a striking visual effect different from that provided by a directed beam of light 6, such as light 6 from a miniature LED lamp.

Figure 5:
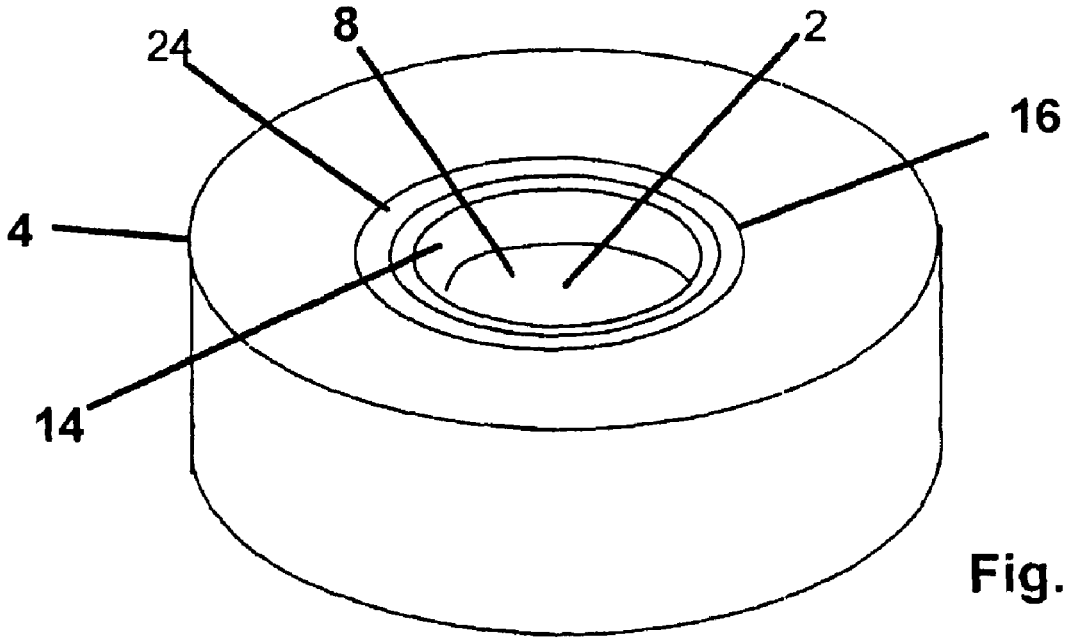
FIG. 5 is a perspective view of the Invention utilizing a display module.
Figure 6:
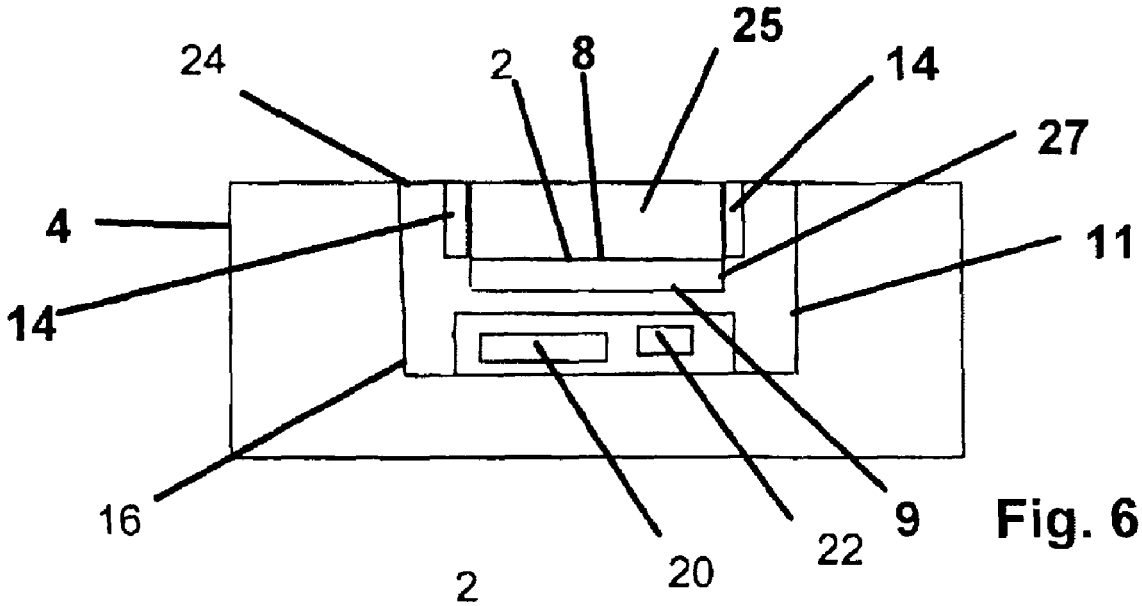
FIG. 6 is a cross section of the display module embodiment.
Figure 7:
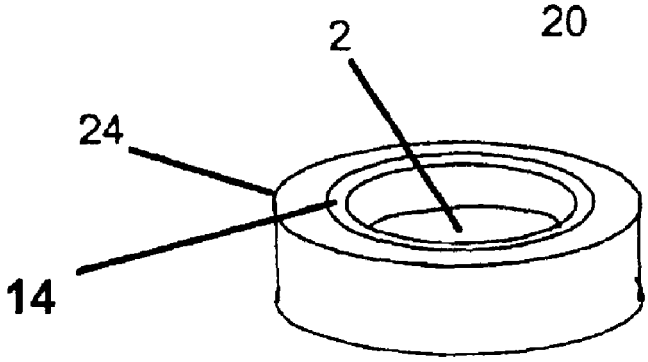
FIG. 7 is a detail perspective view of the display module.

FIGS. 5, 6 and 7 illustrate the use of a removable display module 24. The medallion 2, the light-emitting capacitor lamp 14, power supply 20 and switch 22 all are housed within the display module 24. The removable display module 24 mates with cavity 16 formed in the surface of item of memorabilia 4. The removable display module 24 defines a display module cavity 25 having a display module cavity side wall 26 configured to releasably receive medallion 2. The light-emitting capacitor 14 in the form of a strip bent into a circular shape is mounted to the removable display module 24 within the display module cavity 25 and between the surface 12 of the medallion 2 and the surface 18 of the item of memorabilia 4. The light-emitting capacitor 14 is connected to the power supply 20 and switch 22 for selective illumination of the light-emitting capacitor 14.

Light 6 from the light-emitting capacitor 14 strikes the medallion 2 at a shallow angle, illuminating the medallion 2.

The removable display module 24 of FIGS. 5 through 7 offers the advantage that all openings and fixtures to retain the medallion 2, LED lamps 14, power supply 20 and switch 22 are formed in the display module 24, eliminating the requirement for complex machining or forming of the item of memorabilia 4. The complex shapes of the display module 24 may be formed by injection molding of a polymer or by any suitable technology known in the art. The removable display module 24 also offers the advantage that changes in the functional design of the apparatus may be accomplished with relative ease and at relatively low cost by changing the design of the display module 24 and without changing the design of the item of memorabilia 4 or of the medallion 2.

FIGS. 8 through 16 illustrate medallion 2 enclosed within a transparent or translucent case 28. The use of transparent cases 28 to enclose a minted coin or medallion 2 is conventional to prevent wear of the coin or medallion 2 caused by handling and to allow illumination of the medallion 2 from the rear. The transparent or translucent case 28 may be composed of any suitable material, such as a polymer. The display side 8 of the medallion 2 may be viewed through the case 28.

Figure 8:
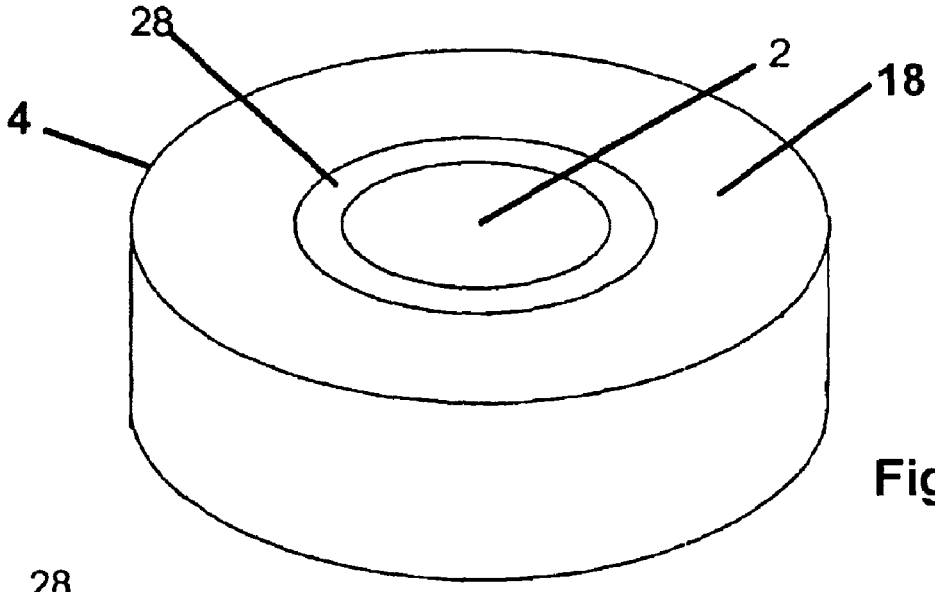
FIG. 8 is a perspective view of an embodiment utilizing a transparent or translucent case.
Figure 9:
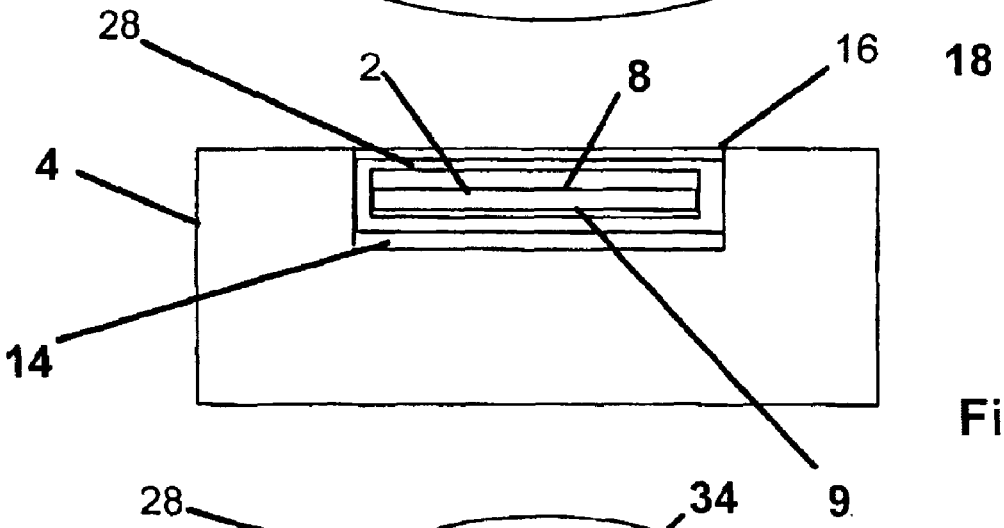
FIG. 9 is a cross section of the case embodiment.

As illustrated by FIGS. 8 and 9, a cavity 16 in the item of memorabilia 4 is configured to receive the transparent or translucent case 28. Light-emitting capacitor lamp 14 is located within the cavity 16 adjacent to hidden side 9 of medallion 2 and behind case 28. The power supply 20 and switch 22 also are located within the cavity 16. The switch 22 may be a pressure-operated switch 22 and may selectably illuminate the light-emitting capacitor lamp 14 when the case 28 is depressed. Any other suitable configuration for a switch 22 may be used.

Figure 10:
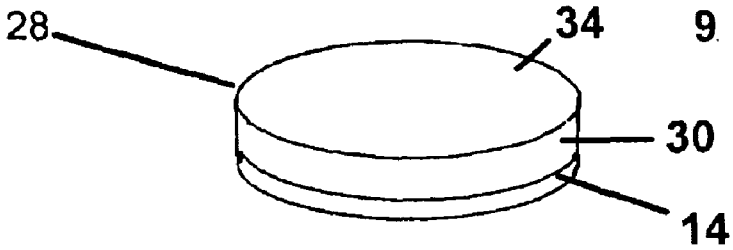
FIG. 10 is a detail perspective of the case and the light-emitting capacitor lamp.
Figure 11:
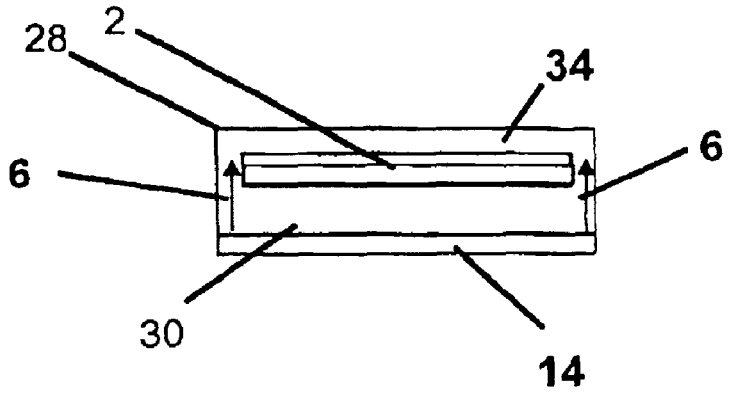
FIG. 11 is a cross section of the case and light-emitting capacitor lamp.

FIGS. 10 and 11 illustrate the case 28 and light-emitting capacitor lamp 14. The medallion 2 is contained within the case 28. When the lamp 14 is activated, light 6 from the lamp 14 enters the rear 30 of the case 28 and is transmitted within the transparent or translucent material forming the case 28 to the front 34 of the case 28. A portion of the light 6 then exits the case 28 and impinges on the surface 12 of the medallion 2 at a shallow angle, lighting the display side 8 of medallion 2. Transmission of light 6 around case 28 is illustrated by FIGS. 14 through 17, discussed below.

Figure 12:
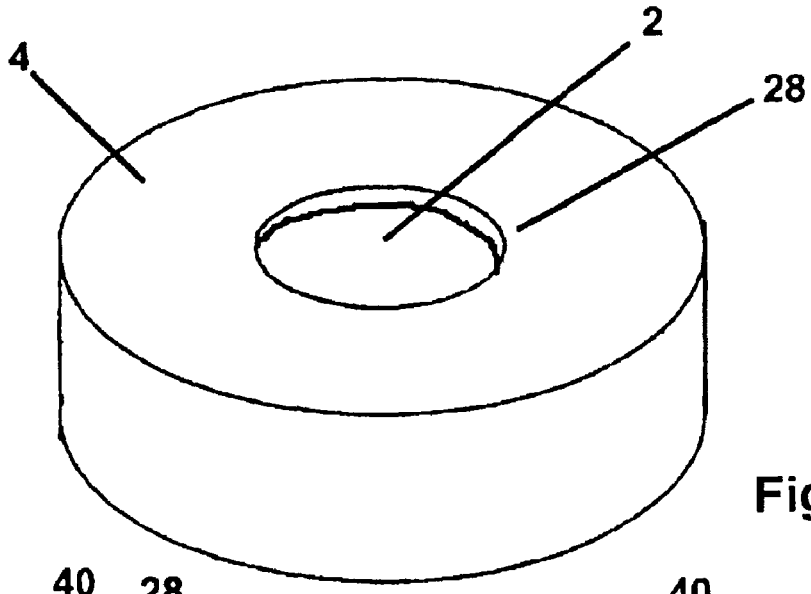
FIG. 12 is a rear-mounted case embodiment.
Figure 13:
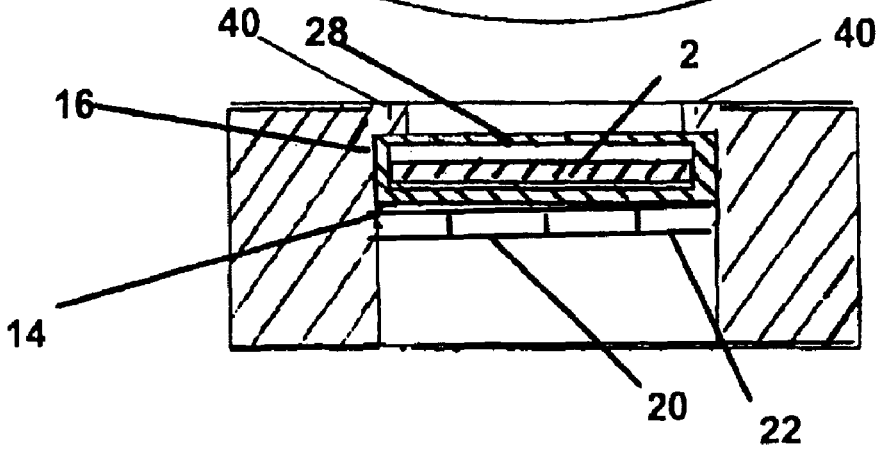
FIG. 13 is a cross section of the rear-mounted case embodiment.

In the embodiment of FIGS. 12 and 13, the cavity 16 in the item of memorabilia 4 communicates through the item of memorabilia 4. Case 28 may be inserted into the cavity 16 from the rear side of the item of memorabilia 4. A lip 40 formed in the surface 18 of item of memorabilia 4 defines the location of case 28 when case 28 is inserted in cavity 16. The lip 40 serves to block light from light-emitting capacitor lamp 14 mounted on the rear side 30 of case 28 from escaping in a direction of a person viewing the medallion 2. Separate display module 24 may be used for the embodiment of FIGS. 12 and 13, together with case 28.

Figure 14:
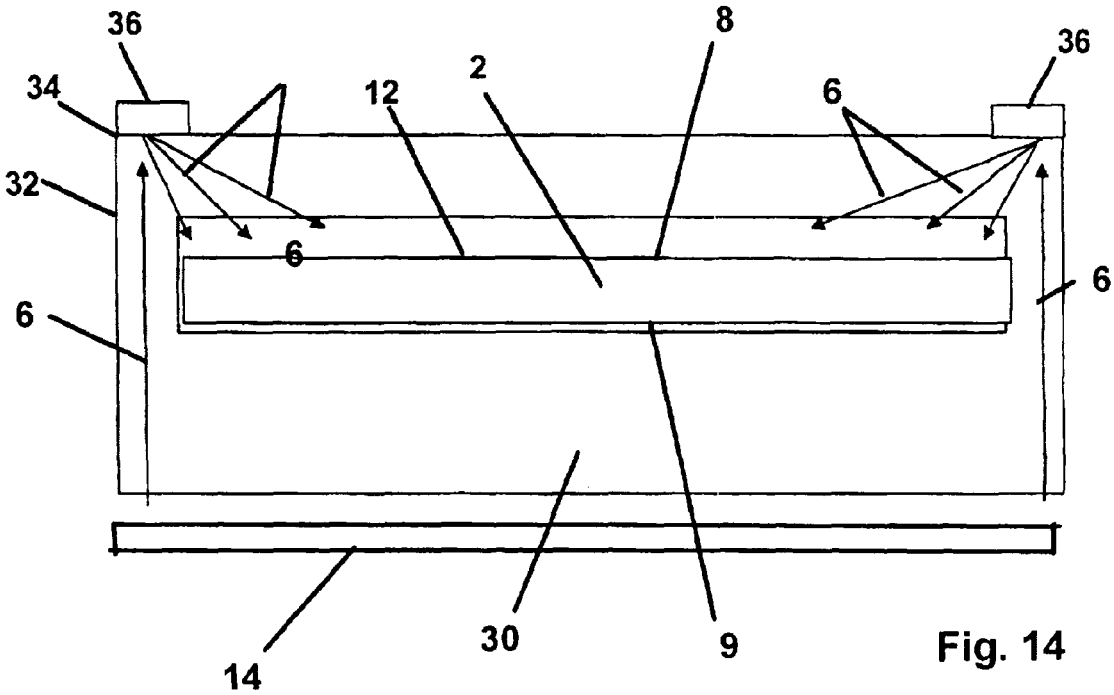
FIG. 14 is a detail cross section of the transparent or translucent case using a mask.

FIGS. 14-17 show configuration of case 28 to provide effective illumination of medallion 2 through case 28. FIG. 14 illustrates use of an annular mask 36. Light 6 travels from the light-emitting capacitor lamp 14 at the rear 30 of the case 28 through the sides 32 of the case 28 to the front 34 of the case 28. A portion of the light 6 may exit through the front 34 of the case 28 and toward an observer. As shown by FIG. 14, an annular mask 36 covers the surface of the case 28 above the sides 32 of the case 28, preventing light 6 from traveling toward the observer through the sides 32 of the case 28. The annular mask 36 may reflect a portion of the light 6 toward the medallion 2, aiding in the lighting of the medallion 2.

Figure 15:
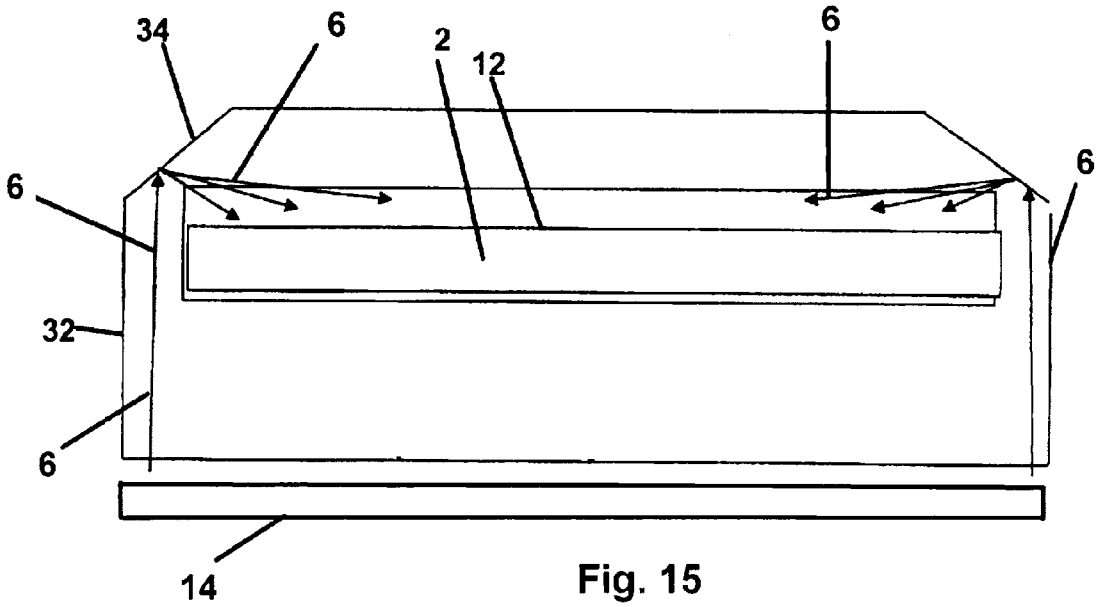
FIG. 15 is a detail cross section of the case using configured to reflect light.

In the embodiment illustrated by FIG. 15, the portion of the case 28 above the sides 32 of the case 28 is configured to reflect additional light 6 toward the medallion 2 from the light-emitting capacitor lamp 14. The front 34 of the case 28 above the sides 32 of the case 28 may be given any suitable shape to direct light 6 toward the medallion 2 and away from an observer and may be a constant angle to the medallion 2 (as shown by FIG. 15) or may be curved.

Figure 16:
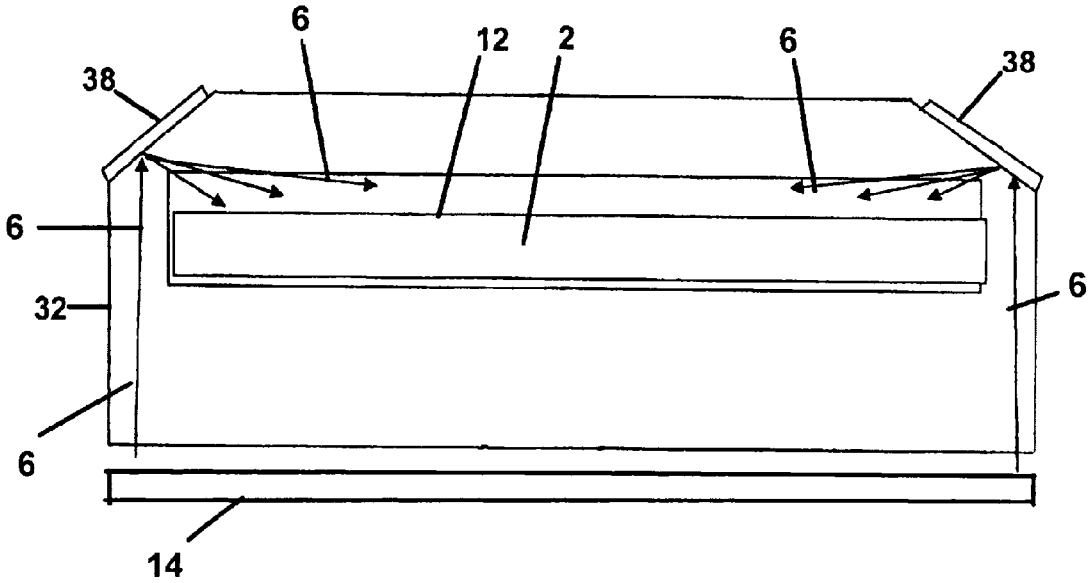
FIG. 16 is a detail cross section of a case utilizing a reflective surface.

The embodiment shown by FIG. 16 provides a reflective surface 38 to direct additional light 6 toward the medallion 2. The reflective surface 38 may be an annular mask 36, as shown by FIG. 15, or may be a reflective coating such as a mirror coating. The reflective surface 38 may be composed of any material that will increase the reflection of light 6.

Figure 17:
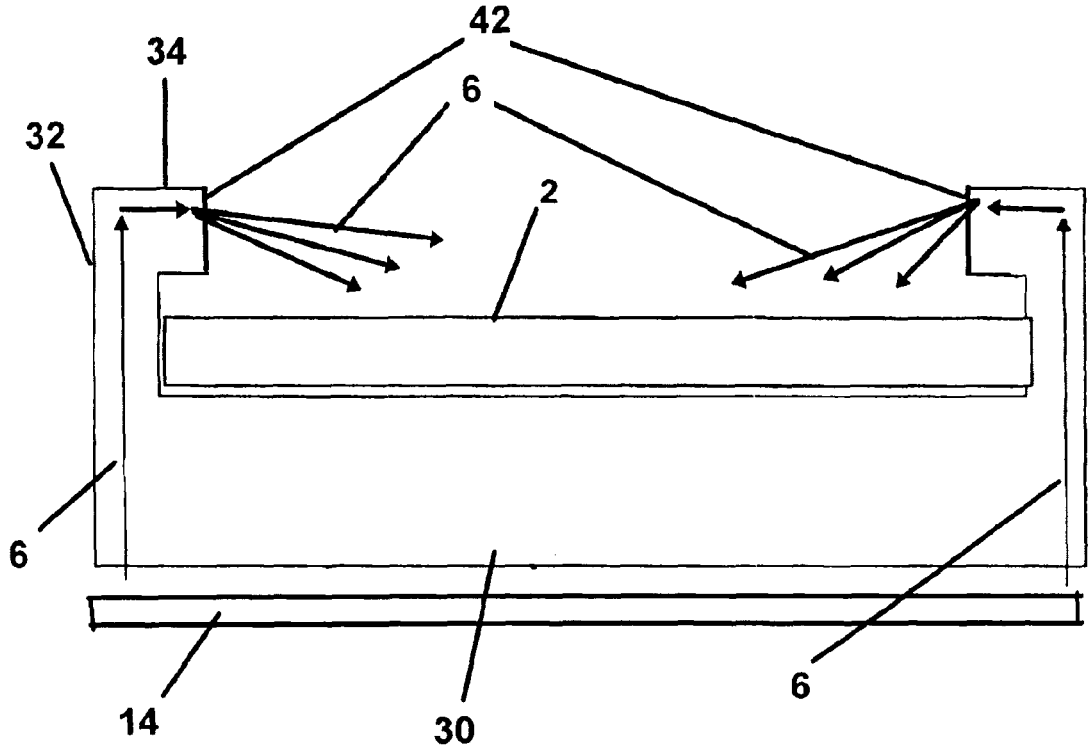
FIG. 17 is a detail cross section of the case having an annular opening.

The embodiment shown by FIG. 17 provides that case 28 has an opening having edge 42. Light 6 traveling from the rear 30 of the case 28 through the material composing the case 28 reaches the edge 42 and exits the case 28. The light 6 is projected across the face of the coin or medallion 2 at a shallow angle. Any or all of the elements of FIGS. 11 and 14-17 may be employed to improve illumination of medallion 2.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. An apparatus for displaying a medallion, the apparatus comprising:

a. an item of memorabilia, said item of memorabilia having a memorabilia surface, said memorabilia surface defining a cavity, the medallion defining two opposing medallion sides, said medallion sides each having a relief, said opposing medallion sides defining a medallion width generally parallel to said display surfaces and defining a medallion thickness generally normal to said display surfaces, said medallion width being large compared to said medallion thickness, the medallion being composed of a lustrous metal, the medallion defining an outside edge oriented substantially normal to said opposing medallion sides, the medallion being selectably supported within said cavity, said cavity being configured to releasably receive the medallion;

b. a light-emitting capacitor lamp, said light-emitting capacitor lamp being supported by said item of memorabilia, said light-emitting capacitor lamp being configured to illuminate selectably a one of said opposing medallion sides when the medallion is received by said cavity, wherein said cavity defines a cavity side wall, said cavity side wall being generally normal to said memorabilia surface and to said one of said display surfaces, said outside edge of the medallion being in a releasable engagement with said cavity side wall, said releasable engagement selectably supporting the medallion within said cavity, wherein said light-emitting capacitor lamp is in a shape of a strip, said strip being in engagement with said cavity side wall between said one of said opposing medallion sides and the medallion surface when the medallion is in said releasable engagement with said cavity side wall.

2. The apparatus of claim 1 wherein said strip is substantially in the shape of a closed circle and is annularly disposed about said cavity side wall.

3. An apparatus for displaying a medallion, the apparatus comprising:

a. an item of memorabilia, said item of memorabilia having a memorabilia surface, said memorabilia surface defining a cavity, the medallion defining two opposing medallion sides, said medallion sides each having a relief, said opposing medallion sides defining a medallion width generally parallel to said display surfaces and defining a medallion thickness generally normal to said display surfaces, said medallion width being large compared to said medallion thickness, the medallion being composed of a lustrous metal, the medallion defining an outside edge oriented substantially normal to said opposing medallion sides, the medallion being selectably supported within said cavity, said cavity being configured to releasable receive the medallion;

b. a light-emitting capacitor lamp, said light-emitting capacitor lamp being supported by said item of memorabilia, said light-emitting capacitor lamp being configured to illuminate selectably a one of said opposing medallion sides when the medallion is received by said cavity;

c. a display module, said display module being in a releasable engagement with the medallion, said cavity defining a cavity side wall, said display module being in a selectable engagement with said cavity side wall, said releasable engagement and said selectable engagement in combination supporting the medallion within said cavity, wherein said display module defines a display module side wall, said display module side wall being generally normal to said memorabilia surface, said releasable engagement comprising said display module side wall being configured to releasable engage said outside edge of the medallion, wherein said light-emitting capacitor lamp is in a shape of strip, said strip being in engagement with said display module side wall between said one of said opposing medallion sides and the memorabilia surface when the medallion is in said releasable engagement with said display module side wall.

4. The apparatus of claim 3 wherein said strip is substantially in the shape of a circle and is annularly disposed about said display module side wall.

5. An apparatus for displaying a medallion, the apparatus comprising:

a. an item of memorabilia, said item of memorabilia having a memorabilia surface, said memorabilia surface defining a cavity, the medallion defining two opposing medallion sides, said medallion sides each having a relief, said opposing medallion sides defining a medallion width generally parallel to said display surfaces and defining a medallion thickness generally normal to said display surfaces, said medallion width being large compared to said medallion thickness, the medallion being composed of a lustrous metal, the medallion defining an outside edge oriented substantially normal to said opposing medallion sides, the medallion being selectably supported within said cavity, said cavity being configured to releasably receive the medallion;

b. a light-emitting capacitor lamp, said light-emitting capacitor lamp being supported by said item of memorabilia, said light-emitting capacitor lamp being configured to illuminate selectably a one of said opposing medallion sides when the medallion is received by said cavity;

c. a substantially transparent or translucent case, said case selectably containing the medallion, said case being selectably supported within said cavity.

6. The apparatus of claim 5 wherein said cavity defines a cavity side wall generally normal to said memorabilia surface, said case being in a releasable engagement with said cavity side wall, said releasable engagement between said case and said cavity side wall selectably supporting the medallion within said cavity.

7. The apparatus of claim 6 wherein said light-emitting capacitor lamp is in a shape of a strip, said strip being in engagement with said cavity side wall between said one of said opposing medallion sides and the medallion surface when said case is in said releasable engagement with said cavity side wall.

8. The apparatus of claim 7 wherein said strip is substantially in the shape of a circle and is annularly disposed about said cavity side wall.

9. The apparatus of claim 5 wherein said cavity defines a cavity side wall, the apparatus further comprising: a display module, said display module being in a releasable engagement with said cavity side wall, said display module defining a display module cavity having a display module cavity side wall, said case being in a selectable engagement with said display module cavity side wall.

10. The apparatus of claim 9 wherein said two opposing sides of the medallion consist of a display side and a hidden side, said display side being proximal to and said hidden side being distal to said memorabilia surface when the medallion is selectably contained within said case, said case is in said selectable engagement with said display module cavity and said display module is in said releasable engagement with said cavity side wall, said light-emitting capacitor lamp being located proximal to said hidden side of the medallion surface, whereby said light-emitting capacitor lamp is located on said hidden side of the medallion and selectably illuminates said display side of the medallion.

11. The apparatus of claim 10, the apparatus further comprising: a power supply supported by said display module, said power supply being operably connected to said light-emitting capacitor lamp, said power supply being configured to selectably supply power to said lamp.

12. The apparatus of claim 11, the apparatus further comprising: an annular mask, said annular mask being disposed about a periphery of a front side of said case.

13. The apparatus of claim 11, the apparatus further comprising: means for directing said light toward said display surface of the medallion.

14. The apparatus of claim 13 wherein said means comprises a reflective material disposed about said periphery of a front side of said case.

* * * * *